US005194223A

United States Patent [19]

Moulton et al.

[11] Patent Number: 5,194,223

[45] Date of Patent: Mar. 16, 1993

[54] METHODS FOR INHIBITING THE CORROSION OF IRON-CONTAINING AND COPPER-CONTAINING METALS IN BOILER FEEDWATER SYSTEMS

[75] Inventors: Roger D. Moulton, The Woodlands, Tex.; Paul R. Burgmayer, Wayne, Pa.

[73] Assignee: Betz Laboratories, Inc., Trevose, Pa.

[21] Appl. No.: 794,532

[22] Filed: Nov. 19, 1991

[51] Int. Cl.[5] ..... C23F 11/08

[52] U.S. Cl. ..... 422/16; 422/14; 252/390; 252/394

[58] Field of Search ..... 422/14, 16; 252/390, 252/394

[56] References Cited

U.S. PATENT DOCUMENTS 4,657,785 4/1987 Kelly et al. ..... 427/255.6

OTHER PUBLICATIONS

CA 74(16): 82358n, "Chelation Compounds as Cooling Water Corrosion Inhibitors," Betz Lab., Inc., (1970).

"Corrosion Inhibition by Phenanthrolines", Corrosion 46 (1990) pp. 376–379; Agarawala.

*Primary Examiner*—Robert J. Warden

*Assistant Examiner*—Timothy M. McMahon

*Attorney, Agent, or Firm*—Alexander D. Ricci; Philip H. Von Neida

[57] ABSTRACT

Methods are provided for simultaneously inhibiting the corrosion of iron-containing and copper-containing metals in contact with boiler feedwaters. The methods comprise adding an effective amount of 1,10-phenanthroline to the boiler feedwater system for which corrosion inhibition is desired.

8 Claims, No Drawings

METHODS FOR INHIBITING THE CORROSION OF IRON-CONTAINING AND COPPER-CONTAINING METALS IN BOILER FEEDWATER SYSTEMS

FIELD OF THE INVENTION

The present invention is directed towards inhibiting the corrosion of iron-containing and copper-containing metallurgies in boiler feedwater systems.

BACKGROUND OF THE INVENTION

The corrosion of copper and iron-bearing metallurgies in steam generation feedwaters has been the subject of increasing concern in those industries utilizing boilers. Consequently, the corrosion can result in reduced reliability, damage to the systems, loss of effectiveness and increased costs due to cleaning, unscheduled outages and replacement of equipment. Transport of copper corrosion products to other boiler surfaces can result in decreased heat transfer and subsequent loss of productivity. Copper deposition on less noble metal surfaces can further exacerbate corrosion problems by causing galvanic corrosion.

Copper corrosion in boiler feedwater systems is primarily caused by the presence of dissolved oxygen, carbon dioxide and ammonia. Even under optimum feedwater condition, low dissolved oxygen and controlled pH, copper oxides will be released as particulate oxides, soluble Cu(I)/Cu(II) and metallic copper species. Copper oxides can continually redeposit within a boiler system, leading to poor heat transfer and tube overheating.

Iron corrosion in boiler feedwater systems is a degradative electrochemical reaction of the metal with its environment. Simply stated, it is the reversion of refined metals to their natural state. When steel corrodes, the loss of metal may result in failure of the boiler wall causing shut down of that particular system.

The problems with corrosion are exacerbated during upset conditions such as low or high pH, high oxygen, chloride or sulfate concentrations. These corrosion problems become even more aggravated when further corrosion-inducing species are introduced into the boiler feedwater. Such species include microbiological growth biocides and oxidizing biocides.

SUMMARY OF THE INVENTION

The present invention pertains to methods for simultaneously inhibiting the corrosion of copper-containing and iron-containing metals in contact with an aqueous system in steam generating feedwaters.

The methods provide for adding an effective amount of 1,10-phenanthroline to said steam generating feedwaters. The present inventors have found that 1,10-phenanthroline works well as a corrosion inhibitor even under gross upsets of the boiler water chemistry.

DESCRIPTION OF THE RELATED ART

U.S. Pat. No. 4,657,785, Kelly et al., April, 1987, teaches a method of reducing copper corrosion in boiler condensate systems. The method employs adding benzotriazole and tolyltriazole or mixtures thereof to the steam header of the boiler. A neutralizing or film-forming amine may also be used in this combination.

EDTA is also known as an additive in boiler water systems. EDTA is used as a hardness inhibitor. However, a drawback to this treatment is that an overfeed of EDTA will attack the iron-containing metals after the hardness problem has been dealt with.

"Corrosion Inhibition by Phenanthrolines", Corrosion 46 (1990) pp. 376–379, Agarwala, discloses that 1,10-phenanthroline was ineffective for steel corrosion inhibition. This compound provided corrosion resistance for aluminum alloys in near neutral pH aqueous systems.

DETAILED DESCRIPTION OF THE INVENTION

The present invention relates to methods for simultaneously inhibiting the corrosion of copper-containing and iron-containing metals in contact with steam generating system feed waters comprising adding to said feedwaters an effective amount for the purpose of 1,10-phenanthroline.

It has been found that the methods of the present invention are also applicable to boiler feedwaters that are experiencing upset conditions. These boilers suffer from low or high pH upsets, high oxygen, chloride and/or sulfate concentrations.

By inhibiting the corrosion of copper-containing and iron-containing metals in the boiler feedwater system, metal lost will not be transported into the boiler. This will help to lessen deposit formation, which in turn lengthens the lifetime of the boiler.

Although applicants are not to be bound to any particular theory of operation, it is believed that the 1,10-phenanthroline compound forms a film on the surface of the copper-containing and iron-containing metals. This film inhibits the metals from corroding from their surfaces.

The words "copper-containing" metals are used to describe the invention, but "copper-containing" includes not only copper metal but its well known alloys such as brass, bronze and Admiralty metal. "Iron-containing" metals is meant to include not only iron metal but its well known alloys such as low carbon steel, cast steel and stainless steel.

The treatment range for the addition of the 1,10-phenanthroline to the boiler feedwater system clearly depends upon the severity of the corrosion problem and the solution concentration of 1,10-phenanthroline employed. For this reason, the success of the treatment is totally dependent on the use of a sufficient amount for the purpose of the 1,10-phenanthroline compound. Broadly speaking, the 1,10-phenanthroline compound can be added to the boiler feedwater in a range from about 1 part per million to about 1000 parts per million of the boiler feedwater sought to be treated. Preferably, the 1,10-phenanthroline is added from about 1 part per million to about 20 parts per million parts boiler feedwater.

The 1,10-phenanthroline may be added as a concentrate or the 1,10-phenanthroline and the boiler feedwater. Suitable solvents include amine/water solutions such as morpholine/water and cyclohexylamine/water solutions. The solvent may also be an aqueous solution of the phosphoric salt of 1,10-phenanthroline at pH of 4 to 5.

The invention can be applied in a boiler feedwater treatment program with many other commonly used materials. These can include but are not limited to: neutralizing or filming amines; oxygen scavengers, tracer chemicals such as molybdate, antifoaming agents; corrosion inhibitors, and the like.

The inventive treatment is anticipated to be effective at any boiler feedwater pH's that are used in the industry.

In order to more clearly illustrate this invention, the data set forth below was developed. The following examples are included as being illustrations of the invention and should not be construed as limiting the scope thereof.

EXAMPLES

Model Economizer Testing

A shell and tube heat exchanger (Model Economizer) with either a mild steel or 90/10 Cu/Ni coil was used in this testing. Untreated feedwater from a small package boiler was used as the influent stream. The coil temperature was fixed at 350° F., and the pH of the stream was maintained between 9.3 and 9.5 when using the steel coil, and between 7.5 and 8.2 when using the Cu/Ni coil. Nitric acid was injected just downstream of the coil exit to insure accurate sampling of the copper and iron concentrations. The chemical treatments were injected into the influent stream using low volume, high pressure pumps.

In a typical run, the Model Economizer was run without chemical feed for two to three hours to measure the pH without acid feed. After the start of the acid feed, samples were taken until at least three samples showed a steady baseline. Chemicals were then fed until three consecutive readings indicated that the steady state was again reached. The results of this testing are presented in Tables I and II.

TABLE I

| Inhibitor | Dosage (ppm) | Fe (ppb) | Avg. (ppb) | Std. Dev. (ppb) |
|---|---|---|---|---|
| Blank | 0 | 100 | | |
| Blank | 0 | 90 | | |
| Blank | 0 | 80 | 90 | 10 |
| Phen | 1 | 40 | | |
| Phen | 1 | 30 | | |
| Phen | 1 | 20 | | |
| Phen | 1 | 30 | 30 | 8 |
| Blank | 0 | 80 | | |
| Blank | 0 | 60 | | |
| Blank | 0 | 60 | 67 | 12 |

Phen = 1,10-phenanthroline

As can be seen from the results of Table I, 1,10-phenanthroline decreased the amount of iron carried from the feedwaters. After 1,10-phenanthroline feed was stopped, the iron concentration almost immediately increased towards its original baseline.

Comparative testing as to copper corrosion inhibitors was performed for 1,10-phenanthroline against n-butyl benzotriazoles. The same procedure as that described in Table I was employed. These results are presented in Table II.

TABLE II

| Inhibitor | Dosage (ppm) | Cu (ppb) | Avg. (ppb) | Std. Dev. (ppb) |
|---|---|---|---|---|
| Blank | 0 | 86 | | |
| Blank | 0 | 98.7 | | |
| Blank | 0 | 101 | 95 | 8 |
| Phen | 1 | 52 | | |

TABLE II-continued

| Inhibitor | Dosage (ppm) | Cu (ppb) | Avg. (ppb) | Std. Dev. (ppb) |
|---|---|---|---|---|
| Phen | 1 | 70 | | |
| Phen | 1 | 67.9 | | |
| Phen | 1 | 71.5 | 65 | 9 |
| Blank | 0 | 106 | | |
| Blank | 0 | 110 | | |
| Blank | 0 | 102 | | |
| Blank | 0 | 105.3 | | |
| Blank | 0 | 108 | | |
| Blank | 0 | 110.7 | 107 | 3 |
| Blank* | 0 | 150.5 | | |
| Blank | 0 | 150.8 | | |
| Blank | 0 | 148 | 150 | 2 |
| Phen | 1 | 75.5 | | |
| Phen | 1 | 79.9 | | |
| Phen | 1 | 77.8 | | |
| Phen | 1 | 80.2 | 78 | 2 |
| Blank | 0 | 161.8 | | |
| Blank | 0 | 150.8 | | |
| Blank | 0 | 148.6 | | |
| Blank | 0 | 191.9 | | |
| Blank | 0 | 168.1 | | |
| Blank | 0 | 163.5 | 164 | 16 |
| b-BZT | 1 | 96.3 | | |
| b-BZT | 1 | 91.1 | | |
| b-BZT | 1 | 90.8 | | |
| b-BZT | 1 | 94.8 | 93 | 3 |
| Blank | 0 | 147.7 | | |
| Blank | 0 | 137.3 | | |
| Blank | 0 | 142.4 | | |
| Blank | 0 | 140.6 | 142 | 4 |

Phen = 1,10-phenanthroline
b-BZT = n-butyl benzotriazole
*After system shutdown and start up 2 days later.

As seen from the results of Table II, 1,10-phenanthroline was as effective at copper corrosion control as n-butyl benzotriazole, a known copper corrosion inhibitor. Further testing was performed employing electrochemical corrosion techniques.

ELECTROCHEMICAL CORROSION TESTING

The polarization resistance of polished 1010 stainless steel at 80° C. was tested in 0.1M phosphate (pH 10.0) in various combinations with 100 ppm NaCl, 1000 ppm EDTA, 8 ppm oxygen or 1000 ppm 1,10-phenanthroline. A graphite rod was used as the counter electrode and a saturated calomel electrode (SCE) was used as the reference electrode.

The testing involved allowing the electrode to form an oxide layer under static conditions and monitoring the corrosion potential ($E_{cor}$) until its value was constant to within +/−1 mV. The resistance polarization (Rp) of the oxide-covered electrode was then measured, followed by a potentiodynamic sweep, to obtain the dynamic corrosion potential and current.

It should be noted that Ecors and Ecord represent the thermodynamic voltages required to corrode the metal under static and dynamic polarization conditions, respectively. Rp is the resistance polarization and represents the kinetic barrier towards corrosion at a given voltage. Icors and Icord represent the corrosion currents under static and dynamic polarization conditions, respectively. Effective corrosion inhibition is exhibited where relatively positive values of Ecor, large values of Rp and small values of Icor are observed.

The results of this testing appear in Table III.

TABLE III

| | | Electrochemical Corrosion Testing 1010 Stainless Steel | | | | | | |
|---|---|---|---|---|---|---|---|---|
| OXYGEN (ppm) | EDTA (ppm) | INHIB (ppm) | CL (ppm) | ECORS (V vs SCE) | ECORD | RP (kohms/cm2) | ICORS (uA) | ICORD |
| 0.00 | 1000 | 0 | 0 | −0.167 | −0.19 | 10.9 | 2.15 | 0.89 |
| 0.00 | 1000 | 1000 | 0 | −0.191 | −0.119 | 6.94 | 3.13 | 1.20 |
| 0.00 | 0 | 0 | 0 | −0.330 | −0.324 | 7.8 | 2.78 | 3.61 |
| 0.00 | 0 | 1000 | 0 | −0.042 | −0.098 | 9.3 | 2.33 | 0.28 |
| 8.00 | 1000 | 0 | 0 | −0.344 | −0.342 | 16.9 | 1.28 | 1.83 |
| 8.00 | 1000 | 1000 | 0 | −0.130 | −0.156 | 9.8 | 2.21 | 0.90 |
| 8.00 | 0 | 0 | 100 | −0.285 | −0.267 | 2.0 | 10.95 | 1.75 |
| 8.00 | 0 | 1000 | 100 | −0.161 | −0.173 | 9.5 | 2.29 | 4.94 |
| 0.00 | 1000 | 0 | 100 | −0.290 | −0.288 | 9.3 | 2.33 | 1.88 |
| 0.00 | 1000 | 1000 | 100 | −0.216 | −0.224 | 81.7 | 0.27 | 0.51 |
| 0.00 | 0 | 1000 | 100 | −0.289 | −0.287 | 67.6 | 0.32 | 1.08 |
| 8.00 | 0 | 0 | 0 | −0.192 | −0.210 | 10.6 | 2.04 | 0.80 |
| 8.00 | 1000 | 1000 | 100 | −0.243 | −0.249 | 14.2 | 1.53 | 1.82 |

The results of Table III indicate that 1,10-phenanthroline works well as a corrosion inhibitor for steel in the presence of a variety of corrosion enhancers. These results further indicate the efficacy of 1,10-phenanthroline under upset boiler conditions, as indicated by its inhibitive ability when oxygen, EDTA and chlorine are all present as contaminants. As seen in the first two results of Table III, only the corrosive effects of a solution containing only EDTA (without added oxygen, chloride, etc.) were not inhibited by the addition of 1,10-phenanthroline.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

Having thus described the invention what we claim is:

1. A method for simultaneously inhibiting the corrosion of copper-containing and iron-containing metals in contact with feedwaters of a steam generating system comprising adding to said feedwaters an effective amount of 1,10-phenanthroline for the purpose of inhibiting corrosion.

2. The method as claimed in claim 1 wherein said 1,10-phenanthroline is added to said feedwaters in a range from about 1 to about 1000 parts per million parts of feedwater.

3. The method as claimed in claim 2 wherein said 1,10-phenanthroline is added to said feedwaters in a range from about 1 to about 20 parts per million parts feedwater.

4. The method as claimed in claim 1 wherein said copper-containing metal is copper.

5. The method as claimed in claim 1 wherein said copper-containing metal is brass.

6. The method as claimed in claim 1 wherein said copper-containing metal is Admiralty metal.

7. The method as claimed in claim 1 wherein said iron-containing metal is low carbon steel.

8. The method as claimed in claim 1 wherein said iron-containing metal is stainless steel.

* * * * *